US005341976A

United States Patent [19]

Rider

[11] Patent Number: 5,341,976

[45] Date of Patent: Aug. 30, 1994

[54] SPEED SQUARE HOLDER

[76] Inventor: Donald C. Rider, P.O. Box 702, Breckenridge, Colo. 80424

[21] Appl. No.: 889,068

[22] Filed: May 26, 1992

[51] Int. Cl.[5] ..... A45F 5/00

[52] U.S. Cl. ..... 224/269; 224/252; 224/253; 224/904; 206/371; 248/303; 24/3 D

[58] Field of Search ..... D3/100–102, D3/104–106; 224/224–226, 234, 242, 245, 252, 253, 268, 269, 904, 191, 247, 248; 206/214, 224, 305, 371; 33/484; 24/3 D, 3 F, 3 G, 3 H, 3 J, 3 L, 3 R, 287, 543, 563; 248/112, 231.8, 302–305, 309.1

[56] References Cited

U.S. PATENT DOCUMENTS

| | | | |
|---|---|---|---|
| D. 248,341 | 7/1978 | Gillenwater | D3/104 |
| D. 257,410 | 10/1980 | Rink | D3/105 |
| D. 319,147 | 8/1991 | Eberle, III | D3/105 |
| 467,263 | 1/1892 | McGervey | 224/253 |
| 1,004,392 | 9/1911 | Ehrlich et al. | 224/248 |
| 1,326,887 | 12/1919 | Wood | 224/904 X |
| 2,526,768 | 10/1950 | Pendergrass | 224/248 |
| 2,665,830 | 1/1954 | Fowler | 224/252 X |
| 3,157,927 | 11/1964 | Roden | D3/106 X |
| 3,508,691 | 4/1970 | Langbehn | 224/248 |
| 4,223,820 | 9/1980 | Vorsanger et al. | 224/253 |
| 4,346,912 | 8/1982 | Habib | 224/42.46 R |
| 4,363,432 | 12/1982 | Warthen | 224/247 |
| 4,684,047 | 8/1987 | Burgwin | 224/253 |
| 4,750,697 | 6/1988 | Tontarelli | 248/304 X |
| 4,819,847 | 4/1989 | Anderson | 224/252 |
| 5,016,796 | 5/1991 | Johnson | 224/245 |
| 5,176,302 | 1/1993 | Smith | 224/252 |
| 5,199,579 | 4/1993 | Van Duyne | 211/90 |
| 5,232,136 | 8/1993 | Unger | 224/269 X |

*Primary Examiner*—J. Casimer Jacyna

[57] ABSTRACT

A speed square holder is adapted for attaching to a belt for supporting a carpenter's triangular speed square tool. The holder is preferably comprised of a single piece of metal wire shaped to form a speed square support portion integral with a clip, or hook, for attachment to a carpenter's tool belt. The holder's support portion includes a generally rectangular, open structure adapted to receive a speed square and to engage and retain an enlarged edge flange, or lip, on the speed square. Opposed ends of the speed square holder's generally rectangular support portion are adapted for engaging respective adjacent corners of the speed square and maintaining the speed square securely in position in the holder for virtually any orientation of the holder and speed square combination. Another embodiment of the speed square holder includes a single wire speed square support portion adapted for secure, quick release coupling to a belt-engaging, inverted U-shaped clip for attachment to and suspension from a carpenter's tool belt.

19 Claims, 2 Drawing Sheets

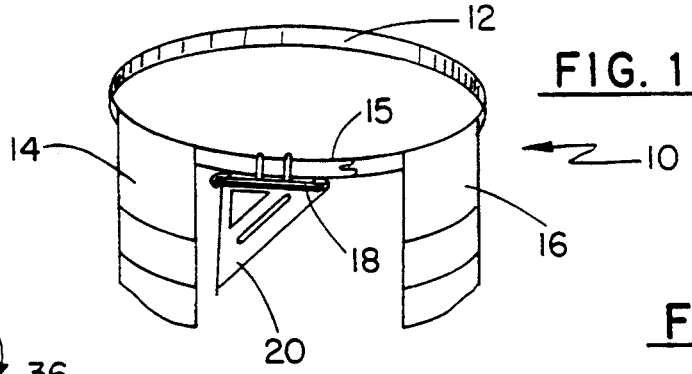
FIG. 1
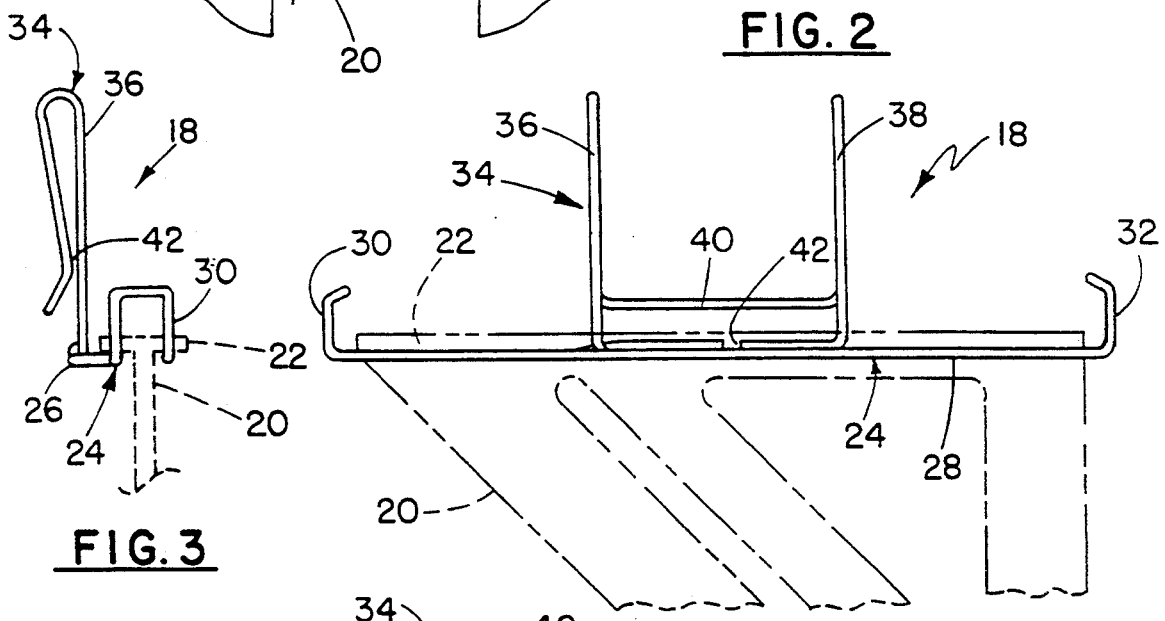
FIG. 2
FIG. 3
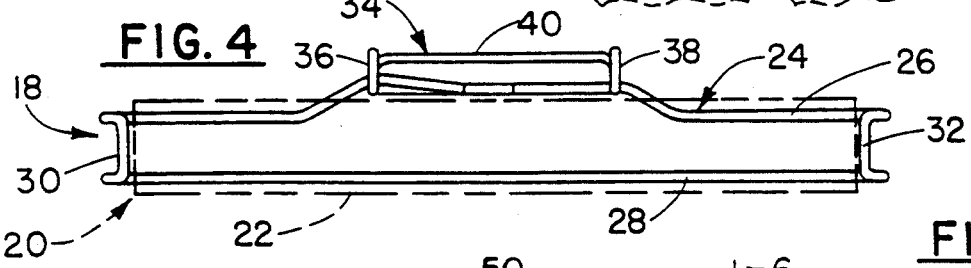
FIG. 4
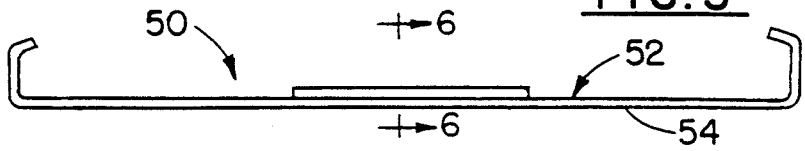
FIG. 5
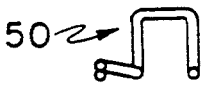
FIG. 6
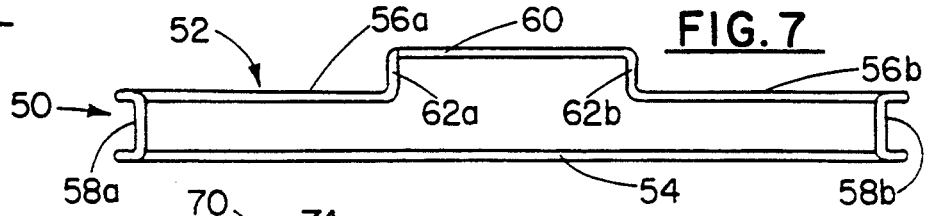
FIG. 7
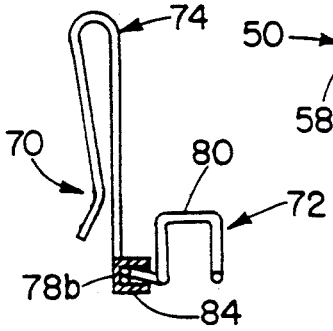
FIG. 9
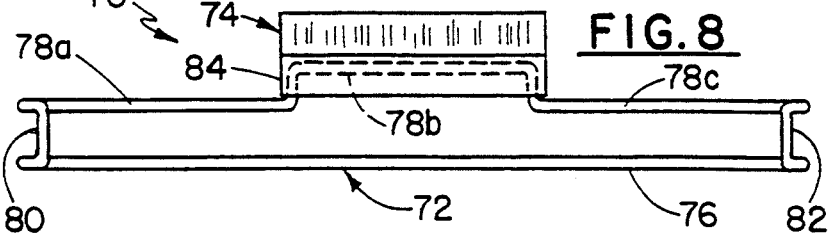
FIG. 8

SPEED SQUARE HOLDER

FIELD OF THE INVENTION

This is invention relates generally to tools such as used by a carpenter and is particularly directed to a holder for suspending a carpenter's speed square from a tool belt.

BACKGROUND OF THE INVENTION

Carpenter's typically use a number of different tools while on the job which are attached to and suspended from a tool belt for convenience. A loop is frequently used for supporting such tools as a hammer while pouches provide support for tape measures and nails. Another tool commonly employed by carpenters is known as a carpenter's square having a generally L-shaped configuration with one long leg and one short leg. The L-shaped carpenter's square is increasingly being replaced with a smaller, triangular shaped speed square. While more convenient to handle and use, the triangular speed square is nevertheless cumbersome to carry.

One approach for carrying a carpenter's speed square is disclosed in U.S. Pat. No. 4,223,820 to Vorsanger et al. U.S. Pat. No. 257,410 also discloses a pouch-like carpenter's square holder. These and other prior art approaches do not account for the constant movement and changing positions of the carpenter while at work resulting in re-orientation of the speed square and its holder. The constant movement of the carpenter as well as the various changes in position and orientation cause the speed square to become dislodged and drop from its holder. U.S. Pat. No. 4,819,847 to Anderson also discloses a carpenter's speed square holder which includes a T-shaped base member to engage the T-shaped edge of the speed square when the tool is inserted into the holder. A locking mechanism is allegedly provided by skewing the ends of the cross-member portion of the T-shaped base member to increase frictional binding of the holder on the speed square. This holder is rather complex, comprised of various interconnected components, and requires precise alignment of opposed ends of the cross-member portion of the T-shaped base member to effectively engage and retain the speed square.

The present invention represents an improvement over the prior art by providing an inexpensive, lightweight, durable speed square holder having a minimum number of components and capable of securely retaining the speed square in virtually any orientation.

OBJECTS AND SUMMARY OF THE INVENTION

Accordingly, it is an object of the present invention to provide an improved holder for a triangular carpenter's speed square.

Another object of the present invention is to provide a speed square holder for use with a carpenter's belt which is lightweight, inexpensive, of sturdy construction and easily attached to and removed from a carpenter's tool belt without taking the belt off.

Yet another object of the present invention is to provide a holder for a carpenter's speed square capable of securely engaging and retaining the speed square when in a substantially inclined orientation as the carpenter assumes various positions.

A still further object of the present invention is to provide a carpenter's speed square holder of reduced size and improved flexibility which allows the speed square to be carried without interfering with the carpenter's work.

This invention contemplates a holder for suspending a carpenter's triangular speed square from a belt, the speed square having a flange on an edge thereof, the holder comprising: a support structure including an elongated slot therein for receiving the speed square and engaging the speed square's flange; a retaining structure disposed on opposed ends of the slot in the support structure for engaging a flanged corner of the speed square when the speed square and holder are positioned in an inclined orientation to prevent separation of the speed square from the holder; and an attachment arrangement coupled to the support structure for suspending the holder and speed square from a belt, wherein the support structure, the retaining structure and the attachment arrangement form an integral structure comprised of a single piece of a thin, elongated member.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 1 is a simplified perspective view of a typical carpenter's tool belt from which a speed square is suspended in accordance with the present invention;

FIG. 2 is a side elevation view of one embodiment of a speed square holder in accordance with the present invention, where a speed square is shown in dotted-line form;

FIG. 3 is an end-on view of the speed square and holder shown in FIG. 2;

FIG. 4 is a plan view of the speed square and holder shown in FIG. 2;

FIG. 5 is a side elevation view of another embodiment of a speed square holder in accordance with the present invention;

FIG. 6 is an end-on view of the speed square holder shown in FIG. 5;

FIG. 7 is a plan view of the speed square holder shown in FIG. 5;

FIG. 8 is a plan view of another embodiment of a speed square holder in accordance with the principles of the present invention; and FIG. 9 is an end-on view shown partially in section of the speed square holder shown in FIG. 8.

DETAILED DESCRIPTION OF THE PREFERRED EMBODIMENTS

Figure 2A:
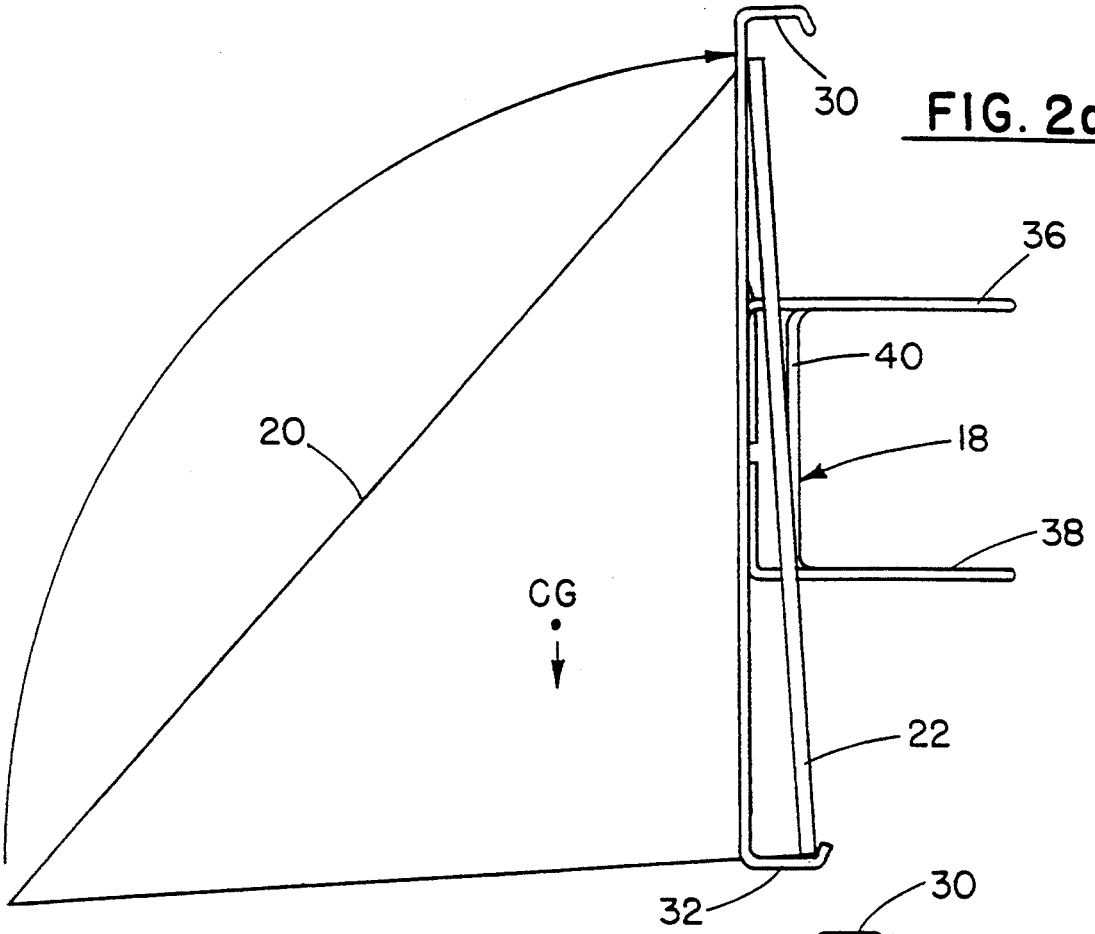
FIGS. 2*a* and 2*b* show the manner in which the speed square is retained in the holder when positioned in a highly inclined orientation.

Referring to FIG. 1, there is shown a simplified perspective view of a typical carpenter's tool belt 10 from which a speed square 20 is suspended in accordance with one embodiment of the present invention. The carpenter's tool belt 10 is comprised of a waist-engaging belt 12 having a buckle 15 and one or more tool bags 14 and 16 suspended therefrom. Belt 12 and tool bags 14, 16 are typically comprised of a durable material such as leather. Each of the tool bags 14, 16 is adapted to carry such carpenter tools as a tape measure or ruler, nails, etc. Other tools such as a hammer may be suspended from belt 12 by means of a loop, although this is not shown in the figure for simplicity. Triangular shaped speed square 20 is suspended from the belt 12 by means of a speed square holder 18 in accordance with the present invention.

Referring to FIG. 2, there is shown a side elevation view of the speed square holder 18 from which speed square 20 (shown in dotted-line form in the figure) is suspended. FIGS. 3 and 4 respectively show end-on and plan views of the combination of speed square holder 18 and speed square 20. Speed square holder 18 is preferably comprised of a single section of a high strength, somewhat resilient and bendable material such as steel wire. Other materials having these characteristics and which are well known to those skilled in the art, such as plastic or various other metals, could be used in forming speed square holder 18. Speed square holder 18 includes a speed square support portion 24 and a clip portion, or hook, 34. Because the speed square support 24 and clip 34 are formed from the same elongated piece of wire, speed square holder 18 is comprised of a unitary structure which is lightweight, inexpensively produced, durable, and of simple construction.

Triangular-shaped speed square 20 shown in dotted-line form has various numerical scales displayed thereon which are not shown in the figure for simplicity. Speed square 20 further includes a lip, or flange, 22 extending along one of its three edges. Speed square support 24 is adapted for engaging the speed square flange 22 along the length thereof by inserting the speed square between spaced first and second elongated support members 26 and 28 forming the lengthwise side portions of the speed square support 24. With speed square 18 inserted in the speed square support 24, the first and second elongated support members 26 and 28 engage the speed square flange 22 in providing support for speed square 18.

Disposed along an intermediate portion of and extending upward from speed square support 24 is clip 34. Clip 34 is generally of an inverted U-shape and is comprised of first and second spaced U-shaped members 36 and 38 and a cross-member 40 extending therebetween. With the speed square holder 18 comprised of a resilient material, spaced portions of the first and second U-shaped members 36, 38 may be urged away from one another permitting clip 34 to be inserted over and securely engage a tool belt. A narrow gap 42 disposed between adjacent, opposed portions of the first and second U-shaped members 36, 38 ensures secure engagement of a carpenter's tool belt by the speed square holder 18 which is securely attached thereto.

Disposed on opposed end portions of speed square support 24 are first and second retaining ends 30 and 32. Each of the retaining ends 30, 32 includes an upwardly extending portion as well as an inwardly extending portion as shown in FIG. 2. Each of the retaining ends 30, 32 is adapted to engage an adjacent corner of speed square 20 when speed square holder 18 is maintained in an inclined orientation. For example, if speed square holder 18 as shown in FIG. 2 is rotated clockwise, the right-hand corner of speed square 20 will be displaced toward and engage the second retaining end 32. Continued clockwise rotation of the speed square holder 18 will cause the end portion of the speed square flange 32 to engage the upper, inwardly directed portion of the second retaining end 32 as shown in FIG. 2*a*.

Figure 2B:
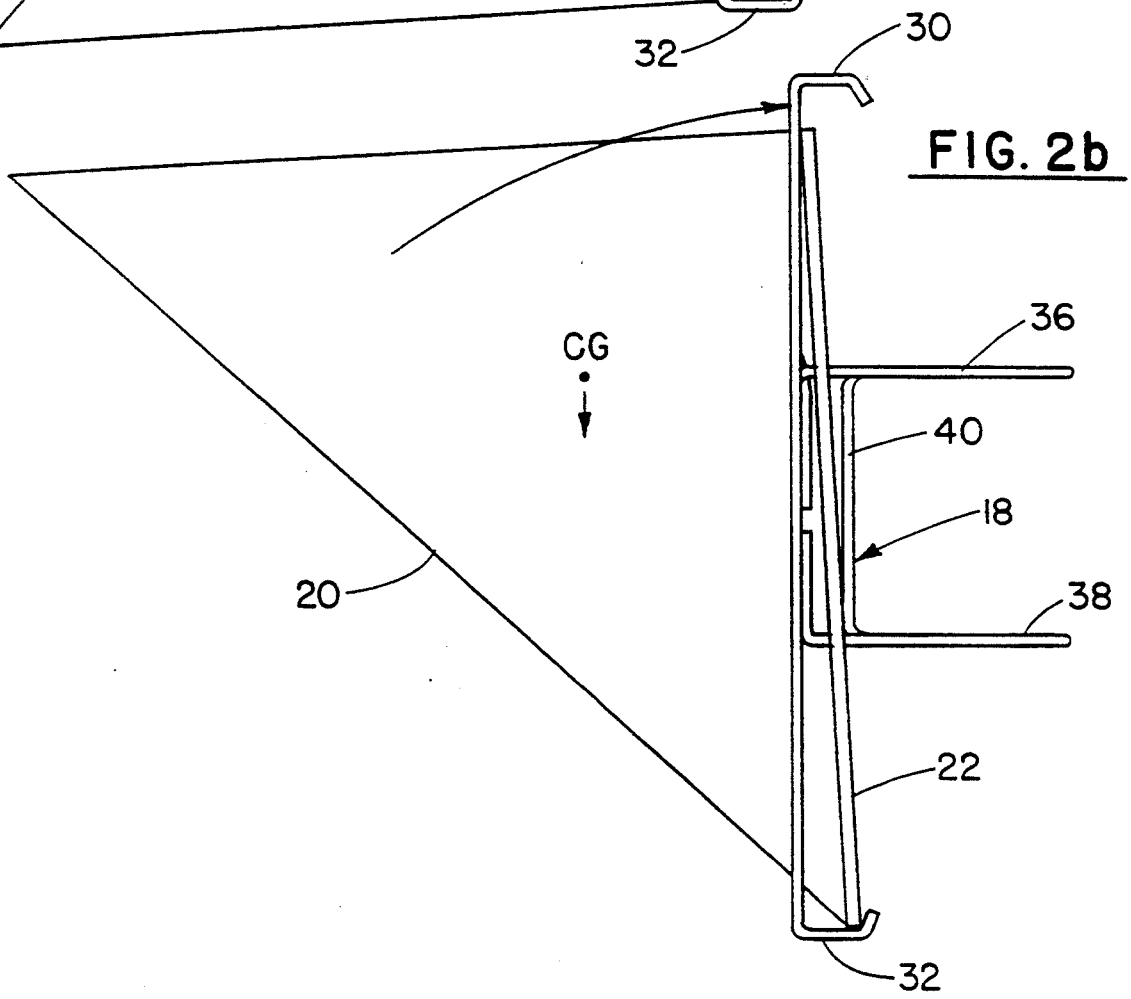

FIG. 2*b* shows the speed square 20 in another orientation in the speed square holder 18. In the arrangement of FIG. 2*b*, the longest edge of the speed square 20 faces downward such that the corner of the speed square formed by its longest edge and its flange 22 engages the inwardly turned distal portion of the second retaining end 32 of holder 18. This prevents further rotation of speed square 20 about its center-of-gravity (CG) and maintains the speed square securely in its holder 18. In both orientations shown in FIGS. 2*a* and 2*b*, holder 18 must be tilted another 20°–40° clockwise before the speed square 20 separates at its upper corner from the holder.

Referring to FIGS. 5, 6 and 7, there are respectively shown side elevation, end-on, and plan views of another embodiment of a speed square holder 50 in accordance with the present invention. In this embodiment, speed square holder 50 includes a speed square support 52 comprised of a first elongated support member 54 as well as second and third elongated support members 56*a* and 56*b* spaced from and generally parallel to the first elongated support member. Disposed between and coupling the second and third elongated support members 56*a*, 56*b* is the combination of a support member 60 and first and second connecting stubs 62*a* and 62*b*. Support member 60 is adapted for receiving an appropriately shaped clip, strap, hook, or other attachment means for connecting the support member 60 of speed square holder 50 to a carpenter's tool belt. The connecting member may be comprised of various materials and assume a variety of shapes well known to those skilled in the art for securely suspending speed square holder 50 from a carpenter's tool belt. Disposed on opposed ends of speed square support 52 are first and second speed square retaining ends 58*a* and 58*b*. First and second speed square retaining ends 58*a*, 58*b* are configured and operate in a manner similar to the speed square holder retaining ends previously described with respect to the first embodiment discussed above.

Referring to FIGS. 8 and 9, there are respectively shown plan and end-on views of yet another embodiment of a speed square holder 70 in accordance with the present invention. Speed square holder 70 includes a speed square support 72 in combination with a hook 74 for attaching the speed square holder to a carpenter's tool belt. Speed square support 72 includes a first elongated support member 76 in combination with second and third elongated support members 78*a* and 78*c* which are arranged in spaced relation from the first elongated support member. Disposed between and connecting the second and third elongated support members 78*a*, 78*c* is a clip attaching member 78*b* which is adapted for engagement by a generally U-shaped clip 84 disposed on the lower edge of hook 74. FIG. 9 is shown partially in section to illustrate details of the U-shaped clip 84. Hook 74 including its U-shaped clip 84 is preferably comprised of a resilient material to allow the U-shaped clip to be placed over and securely engage clip attaching member 78*b* in a snap-acting manner. Opposed end portions of clip 84 are adapted for engaging adjacent opposed end portions of the clip attaching member 78*b* to prevent relative movement between speed square support 72 and hook 74. Disposed on opposed ends of speed square support 72 are first and second retaining ends 80 and 82 which are configured and operate similar to the retaining ends previously described.

There has thus been shown an improved speed square holder which is lightweight, of simple design, inexpensively produced, and durable. The speed square holder is easily attached to and removed from a carpenter's tool belt without removal of the tool belt and is adapted to securely maintain the speed square in position in the holder regardless of the orientation assumed by the speed square and holder combination as the carpenter moves about and changes position while working.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A holder for suspending a carpenter's triangular speed square from a belt, said speed square having a flange on an edge thereof, said holder comprising:

support means including an elongated, rectangular slot having opposed short ends and an open upper portion extending the length thereof for receiving the speed square and engaging the speed square's flange;

retaining means disposed on each of the opposed short ends of the slot in said support means for engaging the opposed ends of the speed square's edge flange when the speed square and holder are positioned in an inclined orientation to prevent separation of the speed square from the holder; and attachment means coupled to said support means for suspending the holder and speed square from a belt, wherein said support means, said retaining means and said attachment means form an integral structure comprised of a single piece of a thin, wire-like elongated member.

2. The holder of claim 1 wherein said thin, elongated member is comprised of metal wire.

3. The holder of claim 2 further comprising solder means for connecting opposed ends of said metal wire disposed adjacent one another in said holder.

4. The holder of claim 3 wherein said metal wire is comprised of steel.

5. The holder of claim 1 wherein said thin, elongated member is comprised of plastic.

6. The holder of claim 1 wherein said support means includes first and second spaced portions of said thin, elongated member with said slot disposed therebetween.

7. The holder of claim 6 wherein said retaining means includes third and fourth portions of said thin, elongated member disposed on respective ends of said first and second portions thereof and extending upwardly and inwardly so as to engage an adjacent flanged corner of the speed square when said adjacent flanged corner is lowered.

8. The holder of claim 1 wherein said attachment means is generally hook-shaped and extends upwardly from a center portion of said support means.

9. The holder of claim 8 wherein said generally hook-shaped portion is comprised of a bendable, resilient material forming a clip-like member adapted for sliding over an edge of the belt.

10. The holder of claim 9 wherein said clip-like member is comprised of a pair of spaced, inverted U-shaped portions and an interconnecting member disposed therebetween.

11. Apparatus for suspending a carpenter's speed square having an edge flange from a tool belt, said apparatus comprising:

support means including an elongated, rectangular slot therein for receiving the speed square and engaging the speed square's edge flange, said slot including first and second opposed short ends;

retaining means disposed on the opposed short ends of the slot in said support means for engaging end portions of the speed square's edge flange when the speed square and said support means are disposed in an inclined orientation to prevent separation of the speed square from said support means, wherein said support means and said retaining means are comprised of a single piece of a thin, elongated wire-like member; and hook means for suspending said support means and a speed square disposed therein from a tool belt, said hook means including quick release clip means for coupling said hook means to an intermediate portion of said support means.

12. The apparatus of claim 11 wherein said thin, elongated member is comprised of metal wire.

13. The apparatus of claim 12 wherein said metal wire is comprised of steel.

14. The apparatus of claim 11 wherein said thin, elongated member is comprised of plastic.

15. The apparatus of claim 11 wherein said support means includes first and second spaced portions of said thin, elongated member with said slot disposed therebetween.

16. The apparatus of claim 15 wherein said retaining means includes third and fourth portions of said thin, elongated member disposed on respective ends of said first and second portions thereof and extending upwardly and inwardly so as to engage an adjacent flanged corner of the speed square when said adjacent flanged corner is lowered.

17. The apparatus of claim 11 wherein said hook means is comprised of a bendable, resilient material adapted for sliding over an edge of a tool belt.

18. The apparatus of claim 17 wherein said quick release clip means is disposed on a lower portion of said hook means and is generally U-shaped for receiving and engaging an intermediate portion of said support means.

19. The apparatus of claim 18 wherein said quick release clip means engages opposed end portions of said support means to prevent sliding displacement between said hook means and said support means.

* * * * *